United States Patent [19]

Holt et al.

[11] 4,325,575

[45] Apr. 20, 1982

[54] HOISTING COUPLING FOR CONCRETE SLABS

[75] Inventors: Jack A. Holt, Belmont; Robert L. Lathrop, San Jose, both of Calif.; Philip A. Torbet, Port Washington, N.Y.

[73] Assignee: The Burke Company, San Mateo, Calif.

[21] Appl. No.: 781,696

[22] Filed: Mar. 28, 1977

[51] Int. Cl.[3] ..... B66C 1/66; E04B 1/00

[52] U.S. Cl. ..... 294/89; 52/125; 52/707; 52/711; 294/86 R

[58] Field of Search ..... 294/78 R, 82 R, 83 R, 294/93, 94, 86, 67 R, 81, 92, 86 R, 89; 52/699, 700, 701, 704, 706, 707, 708, 711, 122, 125, 126

[56] References Cited

U.S. PATENT DOCUMENTS

| | | | |
|---|---|---|---|
| 3,284,125 | 11/1966 | Blaske, Sr. et al. | 294/89 |
| 3,420,014 | 1/1969 | Courtois et al. | 294/89 |
| 4,017,115 | 4/1977 | Holt et al. | 294/89 |
| 4,068,879 | 1/1978 | Torbet et al. | 52/125 X |
| 4,123,882 | 11/1978 | Case et al. | 52/125 |

FOREIGN PATENT DOCUMENTS

| | | | |
|---|---|---|---|
| 893986 | 2/1972 | Canada | 52/125 |

*Primary Examiner*—Alfred C. Perham

*Attorney, Agent, or Firm*—Naylor, Neal & Uilkema

[57] ABSTRACT

A remotely releasable hoisting coupling for engagement with an anchor cast in place within a concrete slab. The anchor provides a passage opening through the surface of the slab and an annular abutment shoulder spaced beneath said surface. The coupling comprises a body insertable into the anchor, a pair of lugs supported in the body at diametrically opposed positions for rocking movement about a diametric axis extending normal to the body, and means to selectively move the lugs between a protruding condition engaged with the abutment shoulder and a retracted condition disengaged from the shoulder. The means to selectively move the lugs comprises a rod axially moveable within the body and having cam surfaces directly engagable with the lugs to force the lugs to the protruding condition and holding surfaces to maintain the lugs in the protruding condition, without loading the cam surfaces. A lifting bail is carried by the body for pivotal movement about an axis extending parallel to the diametric axis of the lugs.

11 Claims, 12 Drawing Figures

HOISTING COUPLING FOR CONCRETE SLABS

RELATED APPLICATIONS

This application is related to commonly assigned copending U.S. patent application Ser. No. 641,529, filed on Dec. 17, 1975 now U.S. Pat. No. 4,017,115, by Jack A. Holt and Philip A. Torbet, two of the inventors herein, and entitled LIFT SYSTEM FOR CONCRETE SLABS. This application is also related to commonly assigned copending U.S. patent application Ser. No. 704,368, filed on July 12, 1976 now U.S. Pat. No. 4,068,879, by Philip A. Torbet and Cyril Thomas Eager, and entitled CONCRETE SLAB HOISTING APPARATUS.

BACKGROUND OF THE INVENTION

This invention relates to a hoisting device for concrete slabs and, more particularly, to an improvement of the remotely operable hoisting coupling disclosed in aforementioned copending application Ser. No. 641,529 now U.S. Pat. No. 4,017,115.

Hoisting couplings for concrete slabs are shown in such patents as U.S. Pat. Nos. 3,420,014; 3,431,012; 3,456,547; and, 3,652,118, and West Germany Pat. No. 1,961,879 of June 16, 1971. Although these patents are relevant to the state of the art, they do not disclose or suggest a structure and mode of operation of the remotely operable hoisting coupling of the present invention.

The prior art is also replete with hoisting couplings for other uses and these are exemplified by the following references of record in the aforementioned copending applications: U.S. Pat. Nos. 2,346,482; 2,948,383; 3,583,753; and, 3,698,756. Although these patents are of some significance, they do not disclose the improved remotely operable lug arrangement employed in the coupling of the present invention.

SUMMARY OF THE INVENTION

The present invention finds utility in the placement of concrete wall units of the type which are cast in a horizontal position and then hoisted into a vertical position at the building site. Engagement of the concrete slab during the hoisting procedure is facilitated by casting an anchor within the slab during its formation. The anchor defines a socket within the slab having an annular abutment for engagement with the hoisting coupling of the present invention.

The hoisting coupling of the invention includes a body sized for entry into the anchor and a pair of diametrically opposed lugs which are selectively extensible into engagement with the annular abutment to lock the coupling to the anchor. In the preferred embodiment, the lugs are mounted for rocking movement about a diametric axis extending normal to the body and the body is provided with a lifting bail pivotally secured thereto for movement about an axis parallel to said diametric axis. The rockable mounting for the lugs and the parallel disposition of said axes promotes uniform loading of the respective lugs, even though the body of the coupling may be subjected to lateral moments as the result of lifting forces applied thereto by the bail.

The invention is also concerned with an improved mechanism for effecting selective movement of the lugs between extended and retracted positions relative to the body of the coupling. This mechanism includes an actuator rod axially movable within the body of the coupling and having cam and holding surfaces thereon for engagement with the lugs to first move the lugs to an extended condition and then lock the lugs in that condition. The holding surfaces extend longitudinally of the actuator rod and, when the rod is in the position maintaining the lugs in the extended condition, the rod is interposed between the lugs with the lugs in abutting engagement with said surfaces. Thus, when the lugs are in the fully extended condition, the rod is in compression between the lugs, and lateral forces imparted to the lugs do not tend to impart axial movement to the rod.

A principal object of the present invention is to provide a hoisting coupling for a concrete slab wherein the load-carrying elements of the coupling are uniformly loaded.

Another and more specific object of the invention is to provide such a hoisting coupling wherein selectively extensible and retractable load-carrying lugs are provided and the lugs are coupled in compression-imparting relation to one another when in the extended condition.

Still another object of the invention is to provide such a lifting coupling wherein a slab engaging plate is carried by the coupling and means is provided to adjust the plate to accommodate slabs of different thicknesses.

The foregoing and other objects will become more apparent when viewed in light of the accompanying drawings and the following detailed description.

DESCRIPTION OF THE PREFERRED EMBODIMENT

Figure 1:
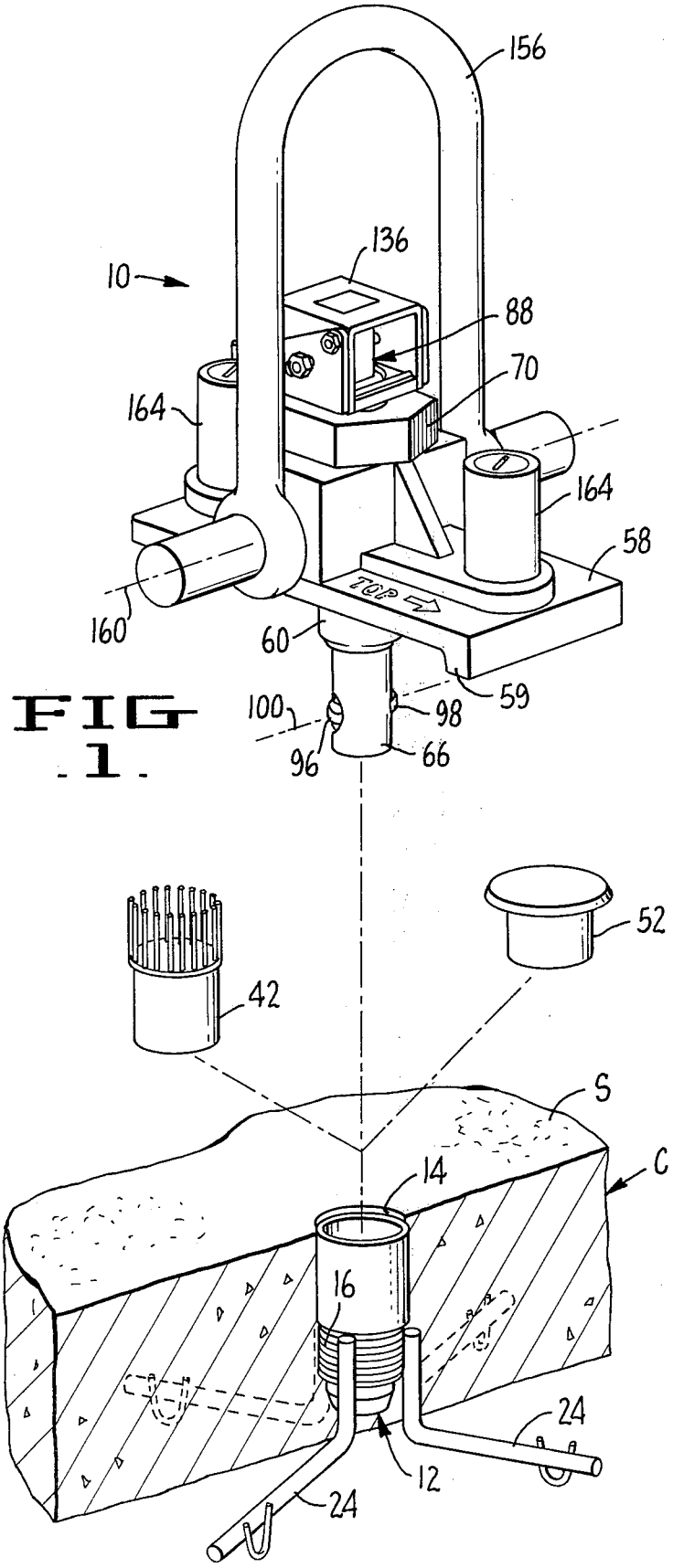
FIG. 1 is an exploded perspective view of the slab and anchor and the hoisting coupling engagable therewith.
Figure 2:
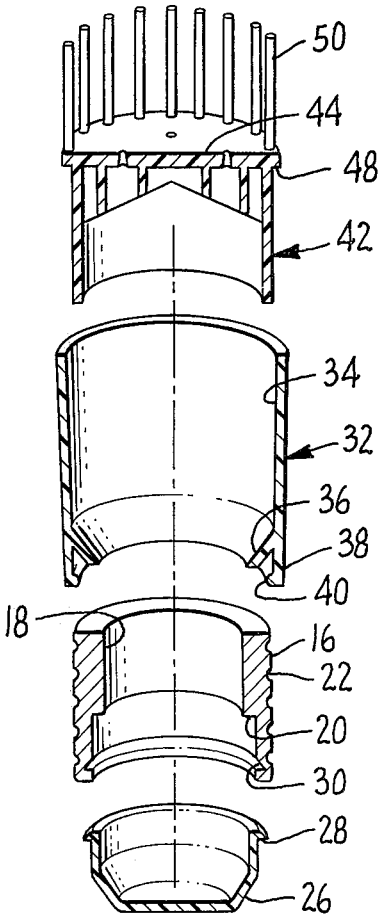
FIG. 2 is an exploded elevational sectional view of the anchor and the plug and guide elements engagable therewith, with parts of the anchor broken away.
Figure 4:
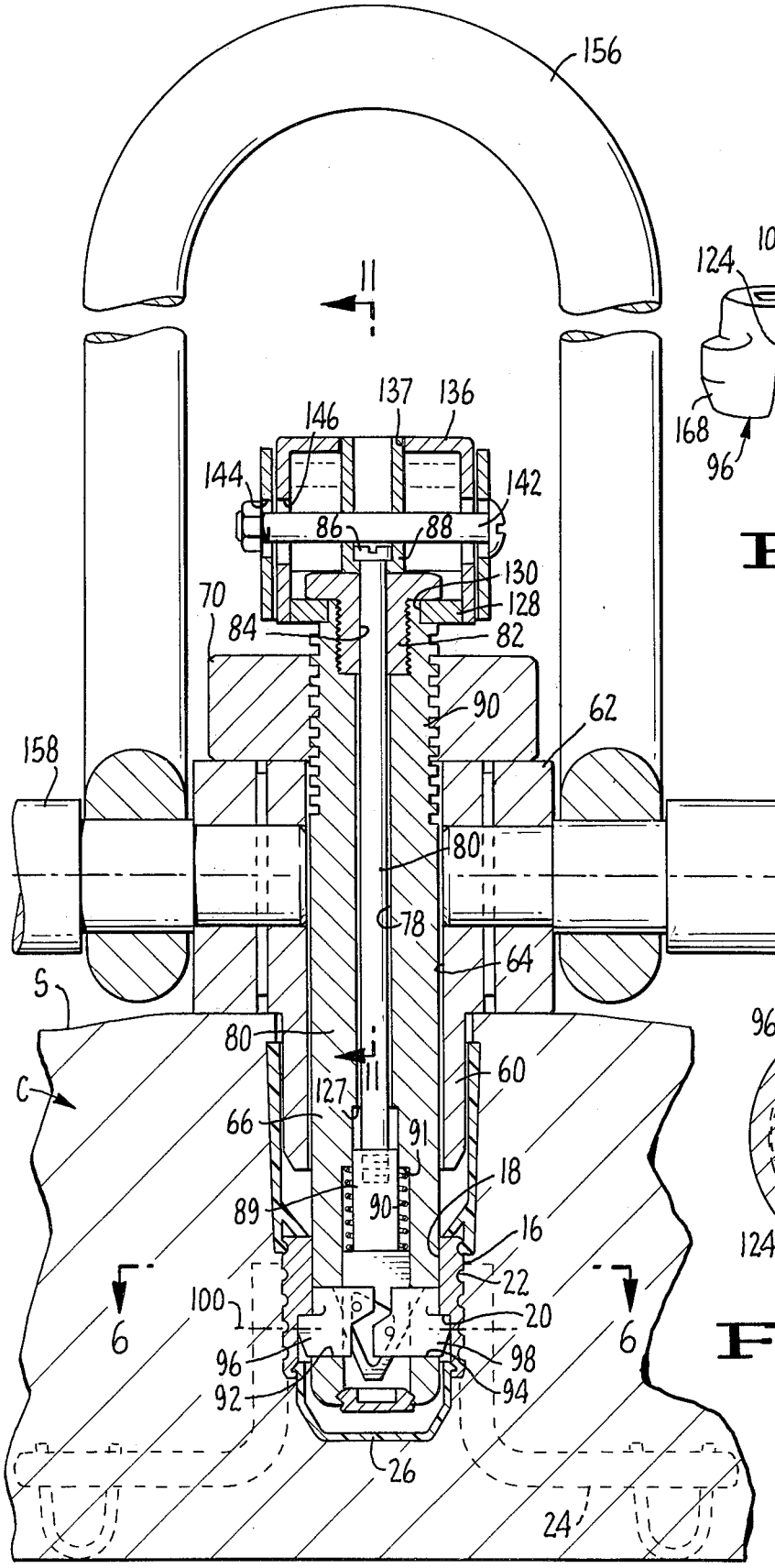
FIG. 4 is an elevational view, in cross-section, of the hoisting coupling engaged in the anchor preparatory to the hoisting of a slab.

Referring now to the drawings, the numeral 10 designates the hoisting coupling and the numeral 12 designates the lifting anchor. As shown in FIGS. 1 and 4, the anchor is imbedded in a concrete slab C having an opening 14 communicating with the interior of the anchor.

The anchor 12 is of essentially the same construction as that shown in copending application Ser. No. 641,529 now U.S. Pat. No. 4,017,115 and comprises, as its basic element, a cylindrical sleeve 16 fabricated of a high-strength material, such as steel. The interior of the sleeve 16 defines a cylindric passage 18 and an annular abutment shoulder 20 is formed within the passage intermediate its ends. The exterior surface of the sleeve is formed with annular grooves 22 which form concavities into which fluid concrete poured around the sleeve may enter to form a firm bond between the sleeve and the concrete. For further enhancing the bond between the sleeve and the slab, legs 24, formed of reinforcing bars or the like, are welded to the exterior of the sleeve. These legs, in addition to enhancing the bond between the sleeve and the concrete, also support the sleeve and other parts of the anchor 12 in an upright position during the introduction of fluid concrete into the form used for casting the slab.

Concrete is excluded from the lower end of the passage 18 by an impervious plastic cap 26 having an annular collar 28 formed therearound for engagement within a groove 30 formed therefor in the sleeve. The cap 26 is sufficiently resilient to permit the collar 28 to be snapped into place within the groove 30. Once so positioned, the cap 26 is secured in sealing engagement with the sleeve 16 and against inadvertent displacement therefrom.

An impervious plastic tubular member 32 is secured to the upper end of the sleeve 16 and provides a passage 34 which provides access to the interior of the sleeve. The diameter of the passage 34 exceeds that of the passage 18 and, as will become more apparent subsequently, facilitates entry of the hoisting coupling 10 into the passage. A smooth transition is provided between the passage 34 and the passage 18 through means of a frusto-conical wall 36 integrally molded with the tubular member 32. The diameter of the lower end of the frusto-conical wall 36 is substantially equal to the diameter of the passage 18. A cylindric extension 38 formed integrally with the member 32 extends beneath the wall 36 and defines an inwardly extending lip 40 for engagement with the uppermost groove 22 in the sleeve 16. The lip 40 functions to both retain the tubular member 32 in place during placement of fluid concrete and to form a fluid-tight joint between the member 32 and the sleeve 16.

Fluid concrete is excluded from the interior of the member 32 through means of a plug 42 telescoped into snug engagement with the passage 34. The plug is formed with an end wall 44 reinforced by ribs 46. A shoulder 48 on the plug 42 limits the extent to which the plug can be inserted into the member 32. Flexible fingers 50 extend upwardly from the periphery of the shoulder 48 so as to extend upwardly through the surface of a concrete slab poured around the anchor and, thus, provide a perforation line in said surface. The fingers 50 are sufficiently resilient that they may readily deflect when screeding and/or trowelling equipment is moved over the surface of the slab. In addition to providing a perforate line in the surface of the slab, the fingers 50 also serve to signal location of the anchor 12.

The fingers 50 differ from the corresponding fingers of the similar plug disclosed in copending application Ser. No. 641,529 in that they are spaced from one another by a distance greater than the diameter of the respective fingers. Although this difference decreases the extent to which the fingers perforate the surface of the slab, it enhances the ease with which the fingers may deflect to facilitate the passage of screeding and trowelling equipment thereover. Once a slab is poured around the anchor and the concrete of the slab is cured, the plug 42 may be removed to afford access to the interior of the anchor.

Figure 3:
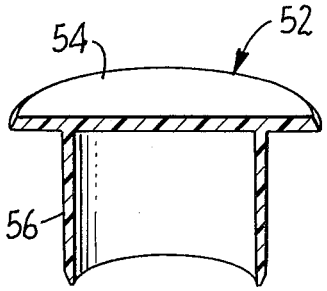
FIG. 3 is a cross-sectional perspective view of a plug element adapted to be inserted into the guide element of the anchor to close the entrance opening to the anchor.

FIG. 3 illustrates a sealing plug 52 adapted to be inserted into the member 32 after a slab has been lifted into place and the hoisting coupling 10 has been removed therefrom. In the preferred embodiment, the plug is fabricated of gray plastic material approximately the color of the concrete slab. The plug 52 has a disc-shaped top 54 of a diameter slightly larger than the diameter of the opening 14 formed in the concrete slab and a cylindric extension 56 dimensioned for snug receipt within the passage 34.

The hoisting coupling 10 includes a base plate 58 having a toe 59 at one end thereof for engagement with the surface, designated S, of the slab C. The plate has formed integrally therewith a cylindric extension 60 and a block 62. The extension 60 is dimensioned for close slidable receipt within the passage 34 of the tubular member 32, and the block 62 and extension 60 are formed with a vertically extending cylindrical passage 64 extending therethrough.

An elongate cylindrical body 66 extends slidably through the passage 64 and is formed at the upper end thereof with external screw threads 68. A nut 70 is received around the body 66 and threadably engaged with the threads 68. The nut is positioned for slidable engagement with the upper surface of the block 62 and, thus, provides means whereby the elevational position of the body 66 relative to the block 62 may be adjusted.

Figure 11:
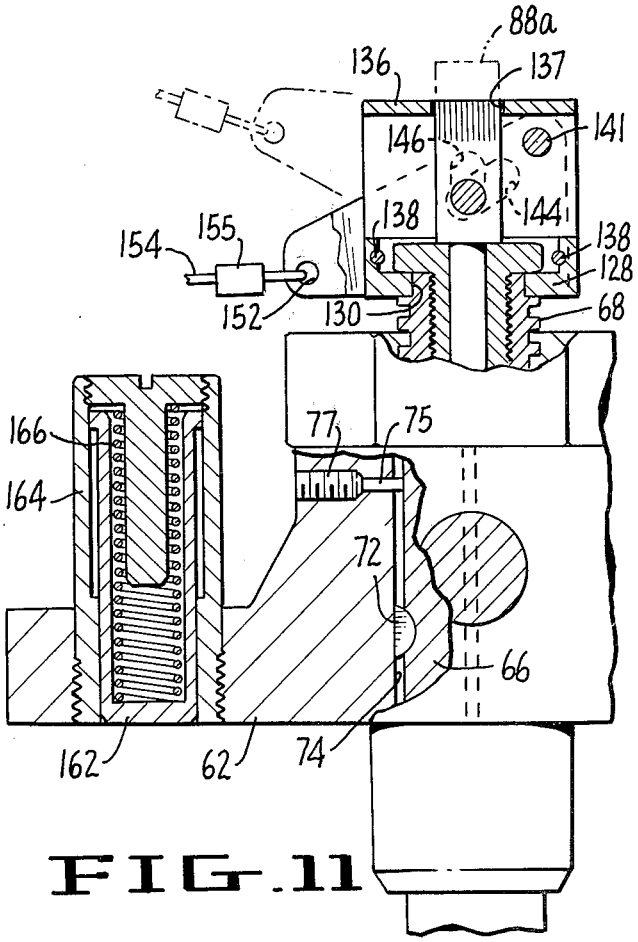
FIG. 11 is a cross-sectional view, with parts thereof broken away, taken on the plane designated by Line 11—11 of FIG. 4; and, FIG. 12 is an elevational view illustrating the hoisting coupling in the process of being used to lift a concrete slab into place.

Referring now to FIG. 11, there it can be seen that the body 66 carries a key 72 slidably engaged in a keyway 74 formed in the block 62 in parallel relationship to the axis of the body 66. The key and keyway maintain the relative rotational orientation of the block and body, irrespective of elevational adjustment of the body relative to the block. A pin 75 is held within the block 62 by a screw 77 and extends into the keyway 74 to prevent the body 66 from being inadvertently separated from the block.

From FIG. 4, it can be seen that an axial bore 78 extends through the length of the body 66 and slidably receives an actuator rod 80. The upper extremity of the bore 78 is enlarged and threadably receives a collar 82 defining a passage 84 coaxial with the bore 78. The rod 80 extends slidably through the passage 84 and terminates at its upper end in an enlarged head 86 received within a block 88. The head 86 secures the block 88 against separation from the rod. The lower end of the rod 80 is threadably engaged in a cylindrical extension 89 and a compression coil spring 90 is interposed between said extension and a shoulder 91 formed in the bore 78. The spring 90 functions to normally bias the rod in a downwardly direction, as viewed in FIG. 4.

Figure 9:
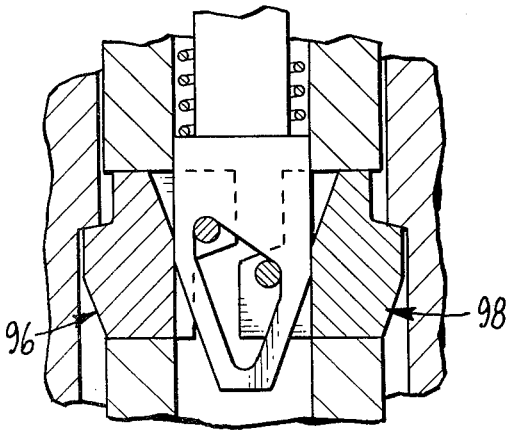

Adjacent its lower end, the body 66 is formed with a pair of diametrically aligned cylindric openings 92 and 94. A pair of lugs 96 and 98 are received within the openings 92 and 94, respectively. The lugs are proportioned for close slidable receipt within the openings and adapted to rotate about a diametric axis, designated 100, extending normal to the body 66 and to slide axially relative to said axis between positions retracted into the body 66 (See FIG. 7) and extended positions protruding laterally from the body (See FIG. 9).

Figure 5:
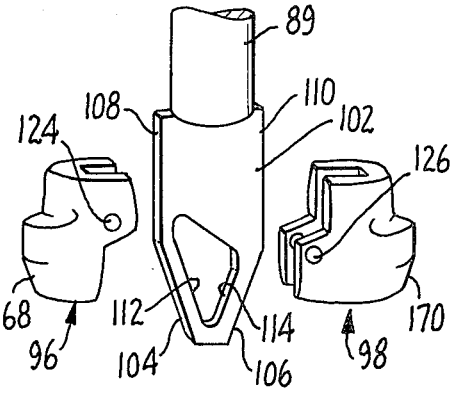
FIG. 5 is an exploded perspective view, with parts thereof broken away, illustrating the lifting lugs and actuator rod of the coupling.
Figure 6:
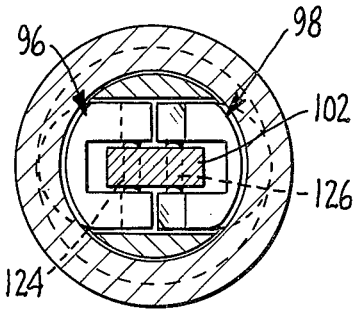
FIG. 6 is a cross-sectional view taken on the plane designated by Line 6—6 of FIG. 4.

The lower end of the cylindrical extension 89 is formed with an integral blade-like extension 102 having converging cam surfaces 104 and 106 and longitudinally extending holding surfaces 108 and 110. Internally, the extension 102 is formed with a peripherally closed slot having converging lower surfaces 112 and 114. The construction of the extension 102 may best be seen from FIG. 5.

Figure 7:
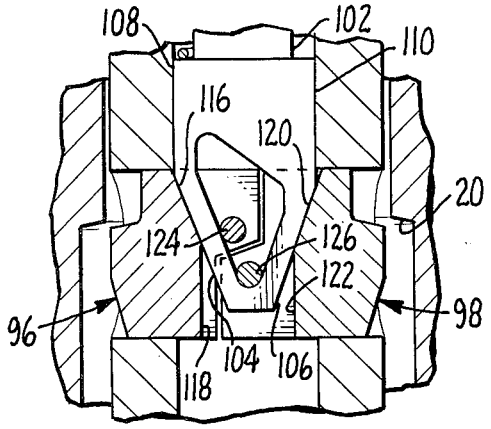
FIGS. 7, 8 and 9 are cross-sectional views of the hoisting coupling and associated anchor, with parts thereof broken away, sequentially illustrating the lifting lugs in the process of being moved between retracted and extended conditions.

The lugs 96 and 98 are internally slotted for slidable receipt around the extension 102 and the inner ends of the lugs are of step-shaped complemental configuration to permit the lugs to retract into the body 66 (See FIG. 7). Lug 96 is formed with a cam surface 116 and a holding surface 118 disposed for complemental slidable engagement with the surfaces 104 and 108, respectively, of the extension 102. Lug 98 is formed with a cam surface 120 and a holding surface 122 disposed for slidable complemental engagement with the cam surface 106 and holding surface 110 of the extension 102. As a result of the complemental slidable engagement between the mating cam and holding surfaces, movement of the actuator rod in a downward direction functions to force the lugs 96 and 98 outwardly and, ultimately, to lock the lugs in the outwardly protruding position. The latter condition may be seen from FIG. 9, wherein the extension 102 is shown interposed in compression between the lugs 96 and 98 with the complemental holding surfaces on the extension and the lugs in abutting engagement with one another. It will be appreciated that, when the complemental holding surfaces are in engagement, the lugs are in opposed compression imparting relationship to one another through means of the extension 102.

The lug 96 carries a pin 124 extending through the slot in the extension for slidable engagement with the surface 112. The lug 98 similarly carries a pin 126 extending through the slot in the extension for slidable engagement with the surface 114. The pins 124 and 126 are so positioned as to slide along the surfaces 112 and 114 and move the lugs 96 and 98 to the retracted position as the actuator rod 80 is progressively moved upward from the position shown in FIG. 9 to that shown in FIG. 7. It should be appreciated that the slot in the extension 102 is of sufficient breadth that lateral impact forces imparted to the lugs will not subject the pins 124 and 126 to significant shear forces.

The pins 124 and 126 are also isolated from any shear forces which may result from an axial movement of the actuator rod within the passage 78. This isolation results because the block 88 abuts against the collar 82 at the downward extremity of rod movement and because the extension 89 abuts against a shoulder 127 in the bore 78 at the upward extremity of rod movement.

Figure 10:
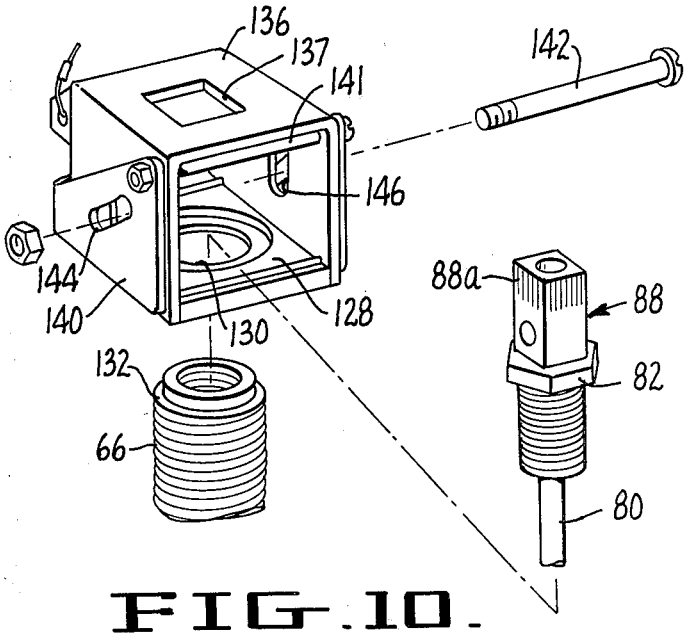
FIG. 10 is an exploded perspective view, with parts thereof broken away, illustrating the lifting lever arrangement for selectively lifting the actuator rod of the coupling.
Figure 8:
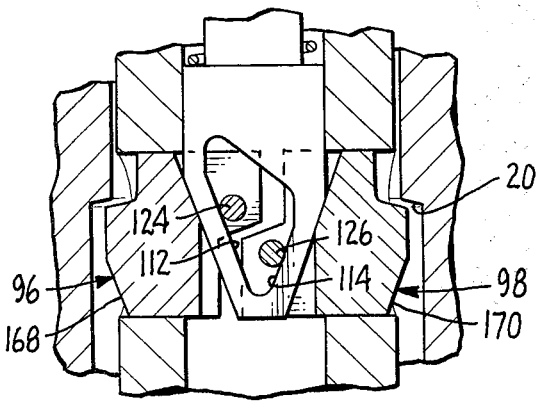

Selective extension and retraction of the actuator rod 80 is provided through means of a cam lever lifting mechanism mounted on the upper end of the body 66. This mechanism may best be seen from FIG. 10 and comprises: a base plate 128 having an aperture 130 therein received around the end of the body 66 in abutting engagement with a shoulder 132 formed adjacent the upward extremity of the body, said plate being secured to the body by the collar 82; an inverted channel 136 secured in spanning relationship to the base plate 128 by screws 138 (See FIG. 11), said channel having an opening 137 formed in the bight portion thereof; a lever 140 of generally U-shaped configuration spanning the channel 136 and pivotally secured thereto by a bolt 141; and, a pin bolt 142 extending slidably through an opening therefor in the block 88, aligned slots 144 in the sides of the lever 140 and aligned slots 146 in the sides of the channel 136. Swinging the lever 140 about the axis defined by the bolt 141 functions to lift the pin bolt 142 and, in turn, the block 88 and attached actuator rod 80. The outer end of the lever 140 is provided with an aperture 152 whereby an actuating line 154 (See FIGS. 1 and 4) may be attached to the plate. A ball lock 155 is interposed in the line 144 and set to release at a tension (e.g., 40 lbs.) insufficient to impart a lifting force to the lever 140 when the lugs 96 and 98 are engaged with the shoulder 20. The purpose of the ball lock is to prevent the lugs from being inadvertently retracted by the application of tension to the line 144 when a slab is being lifted.

The upper end of the block 88 is formed with an extension **88*a* adapted to extend through the opening 137 when the rod 80 is elevated to the position wherein the lugs 96 and 98 are retracted. Projection of the extension 88*a* through the opening 137 serves to signal when the lugs are retracted. Ideally, the extension 88*a*** is colored red so as to draw attention to it.

In operation, the spring 90 functions to normally force the rod to a downwardly disposed position (i.e., that illustrated in FIGS. 4 and 9) wherein the lugs 96 and 98 are extended. By swinging the lever 140 about the axis of the bolt 141 through means of the line 154, the actuator rod 80 may be lifted against the biasing force of the spring 90 to move the lugs 96 and 98 to the retracted position (See FIG. 7).

A U-shaped bail 156 is pivotally secured to the block 62 by pins 150 defining a pivot axis 160 for the bail extending parallel to the diametric axis 100 about which the lugs 96 and 98 are free to rotate. The parallel relationship of these axes minimizes the possibility that lateral forces imparted to the coupling by lifting forces on the bail will function to impart uneven loads to the lugs 96 and 98.

It should be appreciated that the lugs 96 and 98 are free to rotate about the axis 100 to only a limited degree, but that this degree is sufficient to accommodate any lateral movement of the extension 60 within the passage 34 when the coupling 10 is secured to the anchor 12. Rotation of the lugs is limited because the extension 102 of the actuator rod 80 is confined within the slots provided therefor in the lugs. The slots are sufficiently large relative to the extension, however, to permit an appreciable degree of rotation of the lugs. It should also be appreciated that the round configuration of the openings 92 and 94 minimizes the possibility that stress cracks may occur in the body 66 as a result of the lifting loads imparted to the openings by the lugs 96 and 98.

Spring-biased plungers 162 (See FIG. 11) are mounted on the base plate 58 for engagement with the surface of a slab so as to normally bias the plate upwardly relative to the slab. These plungers are received within housings 164 mounted on the base plate and compression springs 166 within the housings function to normally bias the plungers 162 downwardly. The plungers 162 function to lift the hoisting coupling as soon as the lugs 96 and 98 are retracted to a position disengaged from the shoulder 20. Thus, as the hoisting coupling is in the process of being removed from an anchor, the plungers avoid the possibility that the lugs will be inadvertently re-engaged with the shoulder.

Figure 12:
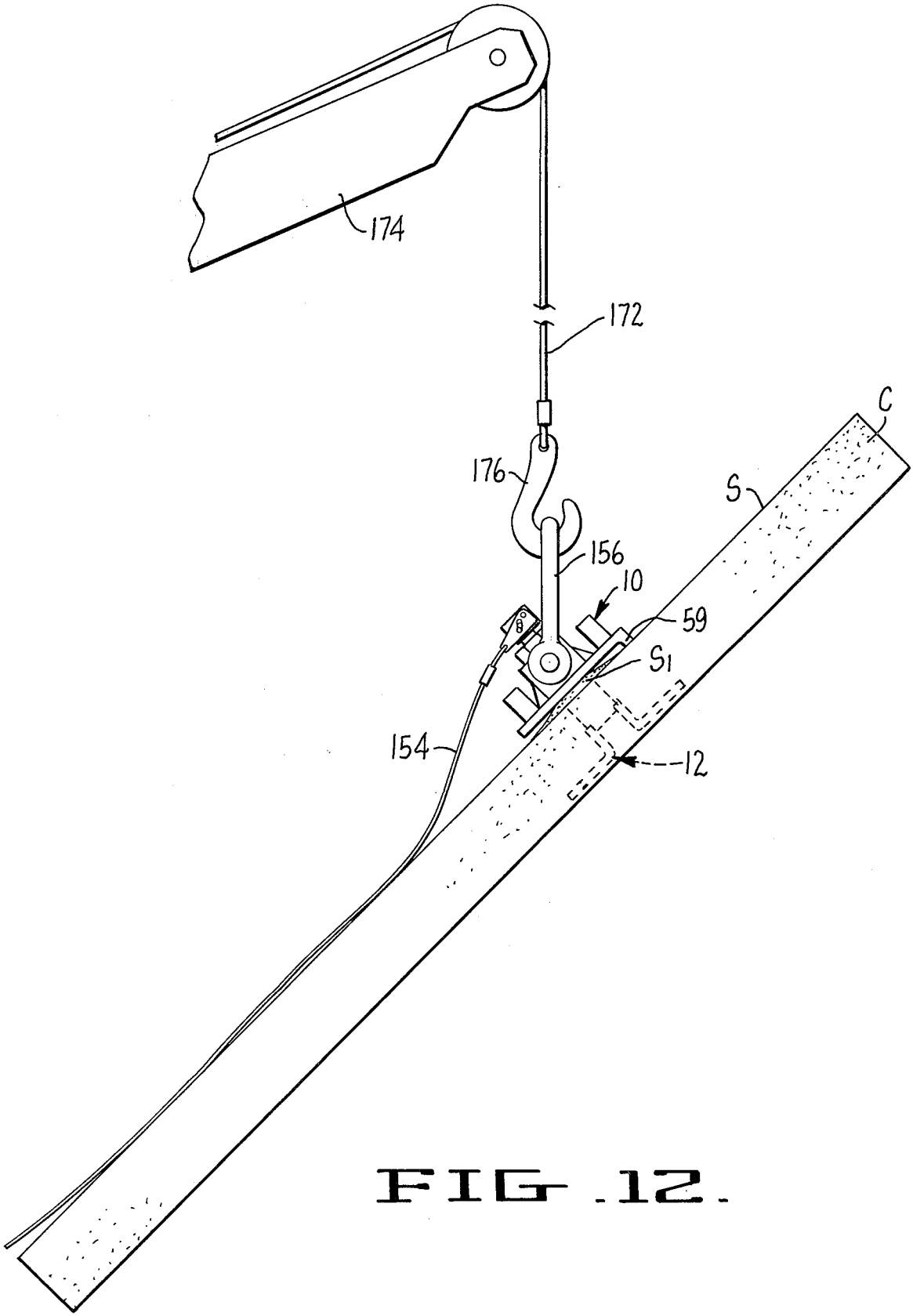

FIG. 12 illustrates the purpose of the foot 59 and the position in which the coupling is secured when lifting a slab.

The purpose of the foot 59 is to assure that the plate 58 will be engaged with the surface of a slab being lifted at a point spaced laterally from the anchor with which the hoist is engaged. Such engagement presents a problem where the surface of the slab is "mounded up" around the anchor, as depicted by the line S, in FIG. 12. The foot overcomes the problem by providing an extension for engagement with the surface of the slab.

The plate 58 is marked with indicia (See FIG. 1) to indicate that the foot 59 should be positioned so as to be disposed at the top of the slab being lifted. The foot extends parallel to the axes 100 and 160 and, as a result, positioning of the foot at the top of the slab positions the coupling so that the bail 156 swings about the axis 160 as the slab is lifted, and the lugs 96 and 98 rock about the axis 100 as the result of any lateral movement of the extension 60 within the passage 34 in response to lifting forces applied to the coupling.

As shown in FIG. 12, the slab C is being hoisted by a lift line 172 extending over a derrick arm 174. A hook 176 secured to the line 172 is engaged with the bail 156. From FIG. 12, it will also be appreciated that the axes 100 and 160 are disposed so as to be parallel to the axis about which the slab is moved as it swings from horizontal to vertical.

In operation, when it is desired to lift the slab C, the actuator rod is lifted to retract the lugs 96 and 98 and the coupling is then inserted into the socket opening formed by the tubular member 32 with the foot 59 positioned so as to be at the top of the slab. Then, the coupling is forced downwardly and converging surfaces 168 and 170 formed on the lugs 96 and 98, respectively, facilitate sliding of the lugs over the frustoconical wall 36 and into the passage 18 of the sleeve 16. When the body 66 reaches a position such that the lugs 96 and 98 are below the abutment shoulder 20, the actuator rod is released and the spring 90 functions to force the rod to a position wherein the lugs are forced outwardly and beneath the shoulder. Thereafter, the nut 70 is rotated to bring the lower surface of the base plate 58 into contact with the slab surface S. In bringing the base plate surface into such relationship, the plungers 162 are compressed into the housing 164 and force is stored in the compression springs 166.

After securing the hoisting coupling in place within an anchor, a hoisting line is engaged with the bail 156 and the slab can be hoisted or tilted up. When the slab is in place and braced, the hoisting coupling can be removed. Even though the hoisting coupling may be in an elevated position, it can be removed without the employment of a ladder because tension on the line 154 can be remotely applied to pivot the lever 140 and, thus, retract the actuating rod 80 to release the coupling.

Conclusion

Although a preferred embodiment of the apparatus has been illustrated and described, it should be understood that the invention is not intended to be limited to the specifics of that embodiment, but rather is defined by the accompanying claims.

What is claimed is:

1. A remotely releasable hoisting coupling for selective engagement with a concrete slab having a surface, a passage formed in the slab in generally perpendicular relationship to the surface and opening therethrough, and an annular abutment within the passage below the surface, said coupling comprising: a body sized for entry into said passage, said body having a longitudinally extending bore formed therein; a single pair of lugs engageable with said abutment and supported in said body for movement relative thereto between a position protruding laterally from said body at which said lugs engage the abutment and a position retracted into said body at which said lugs are disengaged from the abutment, said lugs being rockable relative to the body about a common diametric axis extending normal to the body when engaged with the abutment; an actuator rod axially moveable within said bore; means operatively connecting said lugs to said actuator rod so that in response to axial movement of the actuator rod in one direction relative to said body said lugs are moved to the protruding position and, in response to axial movement of the actuator rod in an opposite direction relative to said body, said lugs are moved to the retracted position; means carried by said body for selectively moving said rod axially relative to said body to move the lugs between the protruding and retracted positions; and, a lifting bail carried by said body so as to be disposed to the exterior of a slab engaged by the coupling, said bail being pivotal about an axis extending parallel to the diametric axis about which the lugs are mounted for rocking movement.

2. A coupling, according to claim 1, further comprising: a plate received around said body; means securing the plate to the body so as to maintain the plate against rotation relative to the body and in a plane normal to the body while permitting the plate to move longitudinally relative to the body; and, stop means carried by the body and engagable with the plate to prevent the plate from separating from the body when the coupling is engaged with a slab, said stop means being adjustable to selectively vary the distance between the plate and the lugs.

3. A coupling, according to claim 2, wherein the lifting bail is carried by the body through means of a connection pivotally securing the bail to the plate for movement about an axis extending parallel to the diametric axis about which the lugs are mounted for rocking movement.

4. A coupling, according to claim 3, wherein one end of the plate is provided with a foot extending away from the body of the plate for engagement with the surface of a slab engaged by the coupling, said foot having a slab engaging surface extending parallel to the axis about which the bail is pivotally secured.

5. A coupling, according to claim 1, wherein the means operatively connecting the lugs to the actuator rod comprises: a first set of cam surfaces formed on diametrically opposite sides of the rod; a second set of cam surfaces formed on the lugs in apposition to the first set of cam surfaces for complemental engagement therewith responsive to axial movement of the rod in one direction relative to the body to force the lugs to the protruding position; and, complementally engagable means carried by the lugs and rod to the interior of the first set of cam surfaces to force the lugs to the retracted position in response to axial movement of the rod in an opposite direction relative to said body.

6. A coupling, according to claim 5, wherein the complementally engagable means comprises a slot formed in the rod, said slot having opposed surfaces converging toward one another; and a pin carried by each of the lugs and extending through the slot, said pins being engagable with said converging surfaces to move the lugs to the retracted position in response to axial movement of the rod in said opposite direction.

7. A coupling, according to claim 5, further including a first set of longitudinally extending holding surfaces formed on diametrically opposite sides of said rod and a second set of longitudinally extending holding surfaces formed on the lugs for complemental engagement with said first set of holding surfaces when the lugs are moved to the fully protruding position.

8. A remotely releasable hoisting coupling for selective engagement with a concrete slab having a surface, a passage formed in the slab in generally perpendicular relationship to the surface and opening therethrough, and an annular abutment within the passage below the surface, said coupling comprising: a body sized for entry into said passage, said body having a longitudinally extending bore formed therein; at least one pair of lugs engageable with said abutment and supported in said body for rocking movement about a diametric axis extending normal to the body and for movement relative to the body between a position protruding laterally from said body at which said lugs engage the abutment and a position retracted into said body at which said lugs are disengaged from the abutment; an actuator rod axially moveable within said bore; means operatively connecting said lugs to said actuator rod so that in response to axial movement of the actuator rod in one direction relative to said body said lugs are moved to the protruding position and, in response to axial movement of the actuator rod in an opposite direction relative to said body, said lugs are moved to the retracted position; a lifting bail carried by said body so as to be disposed to the exterior of a slab engaged by the coupling, said bail being pivotal about an axis extending parallel to the diametric axis about which the lugs are mounted for rocking movement; a compression spring interposed between the rod and body to normally bias the rod in said one direction; and a lever having a portion pivotally secured to the rod and a hinge having an axis to one side of the rod whereby the lever may be pivoted about said axis to move the rod against the bias of the spring in said opposite direction.

9. A remotely releasable hoisting coupling for selective engagement with a concrete slab having a surface, a passage formed in the slab in generally perpendicular relationship to the surface and opening therethrough, and an annular abutment within the passage below the surface, said coupling comprising: a body sized for entry into said passage, said body having a longitudinally extending bore formed therein; at least one pair of lugs engageable with said abutment and supported in said body in diametrically opposed positions for movement relative to the body between a position protruding laterally from said body at which said lugs engage the abutment and a position retracted into said body at which said lugs are disengaged from the abutment, said lugs having cam surfaces formed on the inner ends thereof; an actuator rod axially movable within said bore and having cam surfaces formed on diametrically opposite sides thereof for complemental engagement with the cam surfaces on the lugs to force the lugs to the protruding position upon axial movement of the rod in one direction relative to the body; complementally engageable means carried by the lugs and rod to the interior of the tapered surfaces on the rod to force the lugs to the retracted position in response to axial movement of the rod in an opposite direction relative to said body; a lifting bail carried by said body so as to be disposed to the exterior of a slab engaged by the coupling; a compression spring interposed between the rod and body to normally bias the rod in said one direction; and a lever having a portion pivotally secured to the rod and a hinge having an axis to one side of the rod whereby the lever may be pivoted about said axis to move the rod against the bias of the spring in said opposite direction.

10. A coupling, according to claim 9, wherein the complementally engageable means comprise a slot formed in the rod, said slot having opposed surfaces converging toward one another; and a pin carried by each of the lugs and extending through the slot, said pins being engageable with said converging surfaces to move the lugs to the retracted position in response to axial movement of the rod in said opposite direction.

11. A coupling, according to claim 9, further including a first set of longitudinally extending holding surfaces formed on diametrically opposite sides of said rod and a second set of longitudinally extending holding surfaces formed on the lugs for complemental engagement with said first set of holding surfaces when the lugs are moved to the fully protruding position.

* * * * *